US007086843B2

(12) United States Patent
Cheng

(10) Patent No.: US 7,086,843 B2
(45) Date of Patent: Aug. 8, 2006

(54) COOLING FAN HUB ASSEMBLY

(75) Inventor: Jui-Hung Cheng, Kaohsiung (TW)

(73) Assignee: Asia Vital Components Co., Ltd. (TW)

( * ) Notice: Subject to any disclaimer, the term of this patent is extended or adjusted under 35 U.S.C. 154(b) by 294 days.

(21) Appl. No.: 10/461,110

(22) Filed: Jun. 13, 2003

(65) Prior Publication Data

US 2004/0253126 A1 Dec. 16, 2004

(51) Int. Cl.
*F04B 17/00* (2006.01)
*F04B 35/04* (2006.01)

(52) U.S. Cl. ..... 417/423.1; 417/354

(58) Field of Classification Search ..... 417/423.1, 417/354, 355, 356, 423.12, 423.13, 423.7, 417/423.2, 316, 420
See application file for complete search history.

(56) References Cited

U.S. PATENT DOCUMENTS 2,956,731 A * 10/1960 Bayuk et al. ..... 417/423.14
4,861,237 A * 8/1989 Shiraki et al. ..... 417/353
5,152,676 A * 10/1992 Ohi ..... 417/354
6,290,471 B1 * 9/2001 Horng ..... 417/354
6,386,837 B1 * 5/2002 Horng ..... 417/354
6,398,526 B1 * 6/2002 Yang ..... 417/423.7
6,511,303 B1 * 1/2003 Obara ..... 417/423.12
6,544,011 B1 * 4/2003 Hsieh ..... 417/423.7
6,832,901 B1 * 12/2004 Kuehn et al. ..... 417/423.1
6,916,160 B1 * 7/2005 Obara ..... 417/354
2003/0007879 A1 * 1/2003 Chen ..... 417/355
2003/0063987 A1 * 4/2003 Horng et al. ..... 417/423.14

* cited by examiner

*Primary Examiner*—William H. Rodriguez
(74) *Attorney, Agent, or Firm*—Brinks Hofer Gilson & Lione

(57) ABSTRACT

A hub assembly includes an axle having one end mounted fittingly in a metal socket member. A hub body includes a cylindrical wall formed integrally with a base wall and extending uprightly from an inner surface of the base wall, and a coupling tube formed integrally on the inner surface of the base wall. The cylindrical wall has a central axis transverse to the base wall. The coupling tube extends along the central axis, and has the socket member fixed therein.

7 Claims, 3 Drawing Sheets

COOLING FAN HUB ASSEMBLY

BACKGROUND OF THE INVENTION

1. Field of the Invention

The invention relates to the assembly of a hub and an axle.

2. Description of the Related Art

FIG. 1 illustrates a conventional hub assembly 1 that includes an axle 13 and a hub body 11. The hub body 11 includes a base wall 111 that has opposite inner and outer surfaces 1111, 1112, a cylindrical wall 12 formed integrally with the base wall 111 and extending uprightly from the inner surface 1111, and a coupling tube 112 formed integrally on the inner surface 1111. The cylindrical wall 12 has a central axis (L) transverse to the base wall 111. The coupling tube 112 extends along the central axis (L). The axle 13 has one end retained in the coupling tube 112.

During fabrication, the axle 13 initially is disposed in a mold (not shown), which is used to form the hub body 11, at a predetermined position corresponding to the coupling tube 112. Plastic material is then injected into the mold to form the hub body 11. However, it was found that the axle 13 disposed in the mold is easily crowded by the flow of injected plastic material, thereby resulting in a deviation angle (θ) between the axle 13 and the central axis (L). Therefore, additional steps for correcting the deviation angle (θ) are needed.

FIG. 2 illustrates another conventional hub assembly 2 that includes a metal mounting cap body 22, an axle 23, and a hub body 21. The mounting cap body 22 includes a base wall 220 that has opposite inner and outer surfaces, a cylindrical wall 222 extending uprightly from the inner surface, and a coupling tube 221 formed on the inner surface at the center of the base wall 220. The axle 23 has one end riveted in the coupling tube 221. The hub body 21 is formed on the mounting cap body 22.

During fabrication, the mounting cap body 22 riveted with the axle 23 is disposed in a mold (not shown), which is used to form the hub body 21, and serves as a part of the mold. Plastic material is then injected into the mold to form the hub body 21. While the axle 23 can be precisely positioned in this manner, an additional mechanism for riveting the axle 23 to the mounting cap body 22 is needed, there by resulting in higher production costs.

SUMMARY OF THE INVENTION

Therefore, the object of the present invention is to provide a hub assembly that can be precisely fabricated at a relatively low cost.

According to the present invention, a hub assembly comprises:

a metal socket member;

an axle having one end mounted fittingly in the metal socket member; and a hub body including a base wall having opposite inner and outer surfaces, a cylindrical wall formed integrally with the base wall and extending uprightly from the inner surface of the base wall, the cylindrical wall having a central axis transverse to the base wall, and a coupling tube formed integrally on the inner surface of the base wall and extending along the central axis, the socket member being fixed in the coupling tube.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
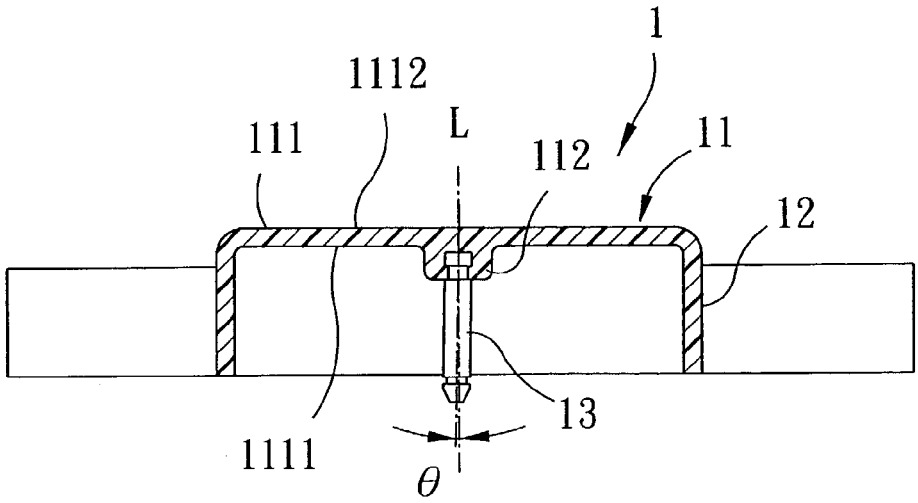
FIG. 1 PRIOR ART
FIG. 1 is a schematic sectional view of a conventional hub assembly.
Figure 2:
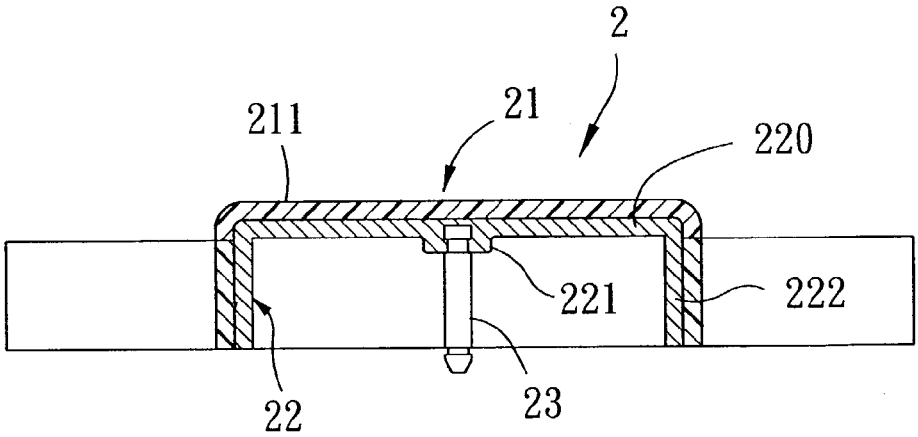
FIG. 2 PRIOR ART
FIG. 2 is a schematic sectional view of another conventional hub assembly.

Before the present invention is described in greater detail, it should be noted that like elements are denoted by the same reference numerals throughout the disclosure.

Figure 3:
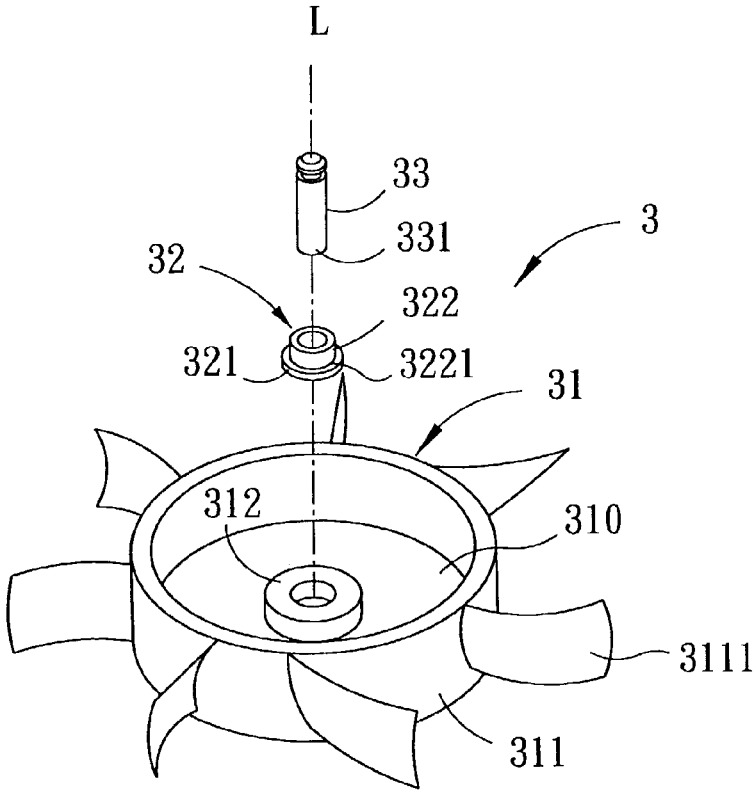
FIG. 3 is an exploded perspective view showing the first preferred embodiment of a hub assembly according to the present invention.
Figure 4:
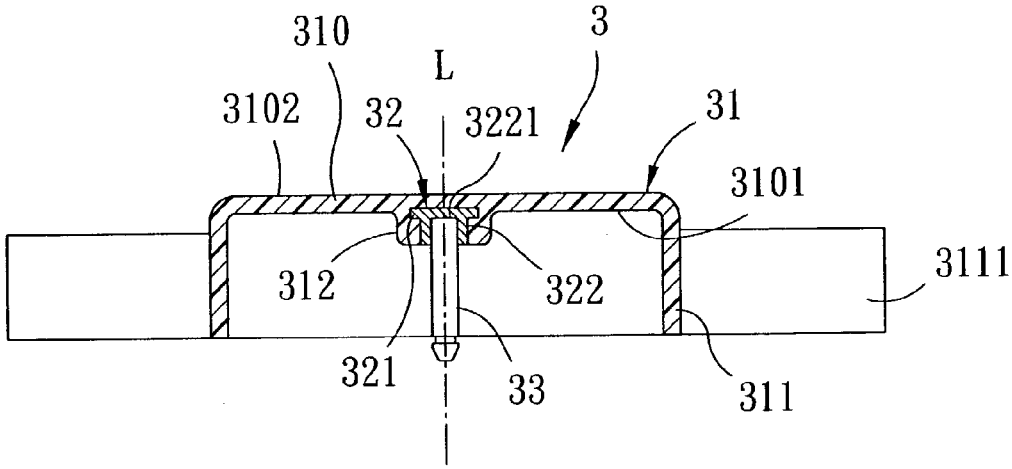
FIG. 4 is a schematic sectional view showing the first preferred embodiment.

Referring to FIGS. 3 and 4, the first preferred embodiment of a hub assembly 3 according to the present invention is shown to include a metal socket member 32, an axle 33, and a hub body 31.

In this embodiment, the socket member 32 is made of copper, and includes a tubular body 322. The tubular body 322 has a closed end 3221 and is formed with a radial outward anchoring flange 321 at the closed end 3221.

The axle 33 has one end 331 mounted fittingly in the socket member 32. In this embodiment, the axle 33 is made of a metal material, such as stainless steel, having a hardness greater than that of the socket member 32 such that the socket member 32 can engage fittingly the axle 33.

The hub body 31 includes a base wall 310, a cylindrical wall 311, and a coupling tube 312. The base wall 310 has opposite inner and outer surfaces 3101, 3102. The cylindrical wall 311 is formed integrally with the base wall 310, and extends uprightly from the inner surface 3101 of the base wall 310. The cylindrical wall 311 has a central axis (L) transverse to the base wall 310. A plurality of blades 3111 are integrally formed with the cylindrical wall 311. The coupling tube 312 is formed integrally on the inner surface 3101 of the base wall 310, and extends along the central axis (L). The socket member 32 is fixed in the coupling tube 312. In this embodiment, the hub body 31 is made of a plastic material, and is formed integrally by injection molding over the socket member 32 after mounting the end 331 of the axle 33 fittingly in the socket member 32 such that the anchoring flange 321 of the tubular body 322 is embedded in the hub body 31, as shown in FIG. 4.

Figure 5:
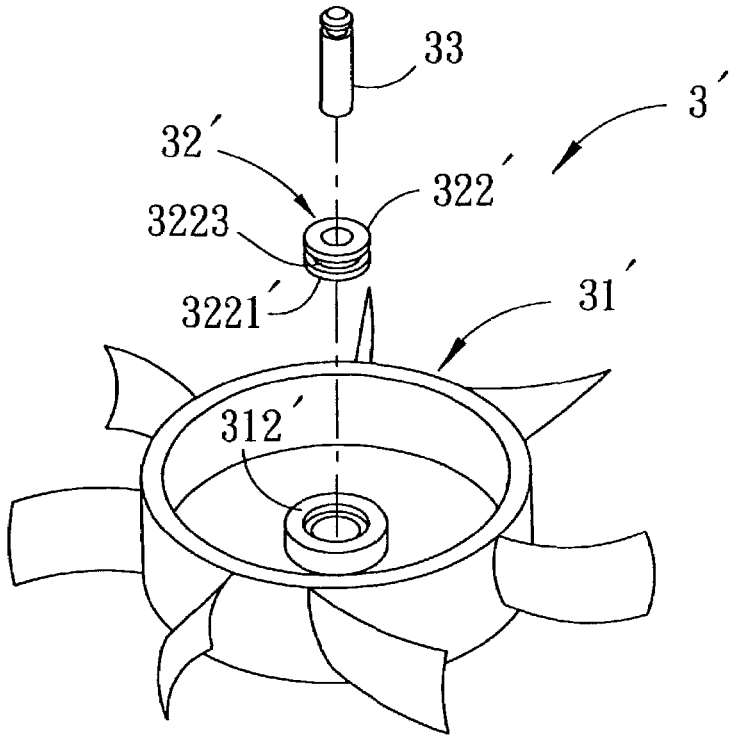
FIG. 5 is an exploded perspective view showing the second preferred embodiment of a hub assembly according to the present invention.
Figure 6:
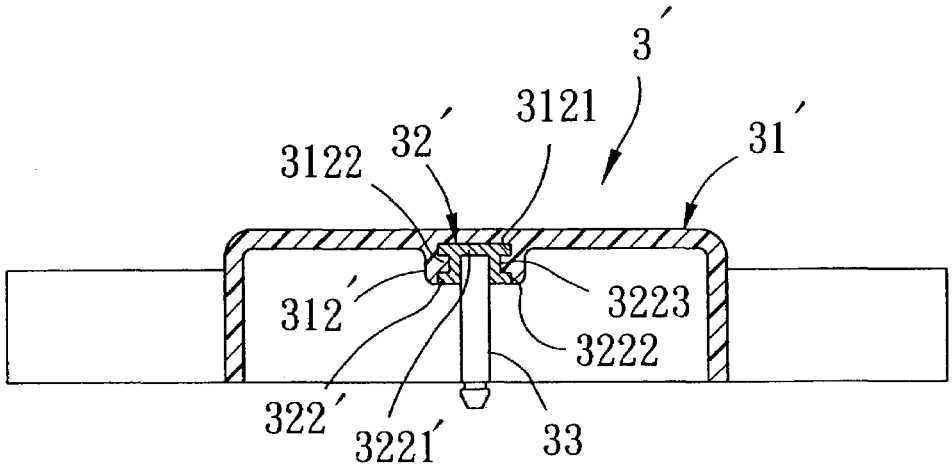
FIG. 6 is a schematic sectional view showing the second preferred embodiment.

FIGS. 5 and 6 illustrate the second preferred embodiment of a hub assembly 3' according to this invention, which is a modification of the first preferred embodiment. Unlike the previous embodiment, the socket member 32' includes a tubular body 322'. The tubular body 322' has a closed end 3221', and an outer surface 3222 formed with an annular engaging groove 3223.

The hub body 31' is formed integrally by injection molding over the socket member 32' after mounting one end of the axle 33 fittingly in the socket member 32' such that the coupling tube 312' has an inner surface 3121 formed with a radial inward annular engaging flange 3122 that engages the annular engaging groove 3223 in the tubular body 322' of the socket member 32'.

Due to the presence of the socket member 32, 32', the axle 33 mounted fittingly in the socket member 32, 32' can be stably disposed in a mold (not shown) for forming the hub body 31, 31' such that the axle 33 can be precisely oriented along the central axis (L) when plastic material is injected into the mold during fabrication. Moreover, since the axle 33 is directly and fittingly inserted in the socket member 32, 32', no additional mechanism is needed so as to result in a relatively low production cost.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A hub assembly comprising:

a metal socket member, wherein said socket member includes a tubular body, said tubular body having a closed end and being formed with a radial outward anchoring flange at said closed end;

an axle having one end mounted fittingly in said metal socket member; and a hub body including a base wall having opposite inner and outer surfaces, a cylindrical wall formed integrally with said base wall and extending uprightly from said inner surface of said base wall, said cylindrical wall having a central axis transverse to said base wall, and a coupling tube formed integrally on said inner surface of said base wall and extending along the central axis, said socket member being fixed in said coupling tube.

2. The hub assembly as claimed in claim 1, wherein said hub body is formed integrally by injection molding over said socket member such that said anchoring flange is embedded in said hub body.

3. The hub assembly as claimed in claim 2, wherein said hub body is made of a plastic material.

4. The hub assembly as claimed in claim 3, wherein said socket member is made of a metal material having a hardness less than that of said axle.

5. A hub assembly comprising:

a metal socket member, wherein said socket member includes a tubular body, said tubular body having an outer surface formed with an annular engaging groove;

an axle having one end mounted fittingly in said metal socket member; and a hub body including a base wall having opposite inner and outer surfaces, wherein said hub body is formed integrally by injection molding over said socket member such that said coupling tube has an inner surface formed with a radial inward annular engaging flange that engages said annular engaging groove in said tubular body of said socket member;

a cylindrical wall formed integrally with said base wall and extending uprightly from said inner surface of said base wall, said cylindrical wall having a central axis transverse to said base wall, and a coupling tube formed integrally on said inner surface of said base wall and extending along the central axis, said socket member being fixed in said coupling tube.

6. The hub assembly as claimed in claim 5, wherein said hub body is made of a plastic material.

7. The hub assembly as claimed in claim 6, wherein said socket member is made of a metal material having a hardness less than that of said axle.

* * * * *